US007191874B2

(12) United States Patent
Tai et al.

(10) Patent No.: US 7,191,874 B2
(45) Date of Patent: Mar. 20, 2007

(54) CARRYING APPARATUS

(75) Inventors: Akito Tai, Kagamigahara (JP); Yuji Imamura, Aichi (JP); Fumiki Goto, Inuyama (JP)

(73) Assignee: Murata Kikai Kabushiki Kaisha, Kyoto (JP)

( * ) Notice: Subject to any disclaimer, the term of this patent is extended or adjusted under 35 U.S.C. 154(b) by 303 days.

(21) Appl. No.: 10/647,244

(22) Filed: Aug. 26, 2003

(65) Prior Publication Data

US 2004/0042887 A1 Mar. 4, 2004

(30) Foreign Application Priority Data

Aug. 29, 2002 (JP) ..... 2002-251205
Aug. 30, 2002 (JP) ..... 2002-255138
Aug. 30, 2002 (JP) ..... 2002-256227

(51) Int. Cl.
*B66B 9/16* (2006.01)

(52) U.S. Cl. ..... 187/244; 187/250; 187/256; 187/257; 187/258; 414/279; 414/282

(58) Field of Classification Search ..... 187/244, 187/240, 255
See application file for complete search history.

(56) References Cited

U.S. PATENT DOCUMENTS 5,433,292 A * 7/1995 Haymore et al. ..... 187/235
5,450,929 A * 9/1995 Ohgita et al. ..... 187/244
6,776,263 B2 * 8/2004 Gottlieb et al. ..... 187/251

FOREIGN PATENT DOCUMENTS

JP S52-116558 A 9/1977
JP H4-31800 U 3/1992
JP H10-194407 A 7/1998
JP 3067528 5/2000
JP 2001-019115 A 1/2001

OTHER PUBLICATIONS

Japanese Notification of Reason(s) for Refusal dated May 2, 2006, issued in corresponding Japanese patent application No. 2002-251205.

* cited by examiner

*Primary Examiner*—Kathy Matecki
*Assistant Examiner*—Terrell Matthews
(74) *Attorney, Agent, or Firm*—Westerman, Hattori, Daniels & Adrian, LLP.

(57) ABSTRACT

The present invention provides a carrying apparatus that prevents an elevating motor and the like from projecting from a stacker crane to hinder the stacker crane from interfering with walls of an automatic warehouse. A traveling vehicle 2 of a stacker crane comprises traveling driving means 20, 20 for wheels 9, and elevation driving means 35 for elevating and lowering a platform 4. Both driving means 20, 35 are arranged so that a longitudinal direction of both driving means 20, 35 is almost parallel with a direction in which the traveling vehicle 2 runs. The traveling vehicle 2 comprises a pair of frames 17, 17 spaced at a predetermined distance from each other and a plurality of connecting members that connect both frames 17, 17 together. Both driving means 20, 35 are arranged outside the respective frames 17. Wheels 9, 9 are arranged in the front and rear, respectively, of the traveling vehicle 2. The traveling driving means 20 is connected to each wheel 9. An elevating pulley 34 for the platform 4 is arranged between the front and rear wheels 9, 9. The elevation driving means 35 is connected to the elevating pulley 34.

7 Claims, 10 Drawing Sheets

CARRYING APPARATUS

FIELD OF THE INVENTION

The present invention relates to a carrying apparatus applied to an automatic warehouse, and in particular, to a configuration of a traveling vehicle provided in the carrying apparatus.

BACKGROUND OF THE INVENTION

In a stacker crane that loads and unloads articles onto and from shelves in an automatic warehouse, a mast extends vertically from a traveling vehicle located at the bottom of the stacker crane. Thus, a platform is elevated and lowered along the mast. A transfer device is mounted on the platform to transfer articles.

In a known stacker crane, the traveling vehicle is provided with an elevating motor for elevating and lowering the platform and a running motor for causing the traveling vehicle to run. In this stacker crane, the elevating motor and the running motor are disposed below the mast and so that their longitudinal direction is orthogonal to a running direction. The elevating motor and the running motor project from the mast in a direction orthogonal to the running direction in a plan view. A dead space is formed below the lowermost shelf in the automatic warehouse: this space is required to elevate and lower the platform appropriately. A projecting portion of the stacker crane is arranged in this dead space so as to eliminate the need to increase the floor space of the entire automatic warehouse. However, a station for a processing device connected to the rear of the automatic warehouse may be arranged below the shelves in the automatic warehouse. In this case, the station is disposed in the dead space. This stacker crane has an increased width corresponding to the projection of the elevating motor and running motor from the mast. Accordingly, the size of a traveling path must be increased in proportion to the size of the projecting portion. This disadvantageously increases the floor space of the automatic warehouse. It is thus an object of the present invention to provide a carrying apparatus that can prevent an increase in the width of the traveling vehicle even if the elevating motor and the running motor are disposed in the traveling vehicle.

SUMMARY OF THE INVENTION

A description has been given of the problems to be solved by the present invention. Now, a description will be given of means for solving the problems. According to Claim 1, the present invention provides a carrying apparatus comprising a traveling vehicle, a mast extending vertically from the traveling vehicle, and a platform that elevates and lowers along the mast, wherein the traveling vehicle comprises traveling driving means for wheels and elevation driving means for elevating and lowering the platform, and both driving means are arranged so that a longitudinal direction of both driving means is almost parallel with a direction in which the traveling vehicle runs.

In Claim 2, the traveling driving means and the elevation driving means are arranged below the mast and so as not to project from a front or rear end of the traveling vehicle in a side view.

In Claims 3 and 4, the traveling vehicle comprises a pair of frames spaced at a predetermined distance from each other and a plurality of connecting members that connect both frames together, and wheels are arranged between the pair of frames in the front and rear, respectively, of the traveling vehicle. Further, traveling driving means is connected to each wheel, and an elevating pulley for the platform is arranged between the front and rear wheels. Furthermore, the elevation driving means is connected to the elevating pulley, and the traveling driving means and elevation driving means are arranged outside the respective frames.

In Claim 5, a bottom of the platform can be housed between the pair of frames.

In Claim 6, mast supporting members project outward from the respective frames constituting the pair, and the mast is arranged above the frames and mast supporting members.

In Claim 7, the traveling driving means and the elevation driving means are arranged inside an outer surface of the mast in a plan view.

DETAILED DESCRIPTION OF THE PREFERRED EMBODIMENTS

Now, an embodiment of the present invention will be described.

First, with reference to FIGS. 1 and 2, a brief description will be given of a configuration of a stacker crane 1 that is an embodiment of a carrying apparatus according to the present invention. In the description below, a direction in which the stacker crane 1 runs is defined as a front-to-rear direction. The direction orthogonal to the running direction in a horizontal plane is defined as a lateral direction.

Figure 1:
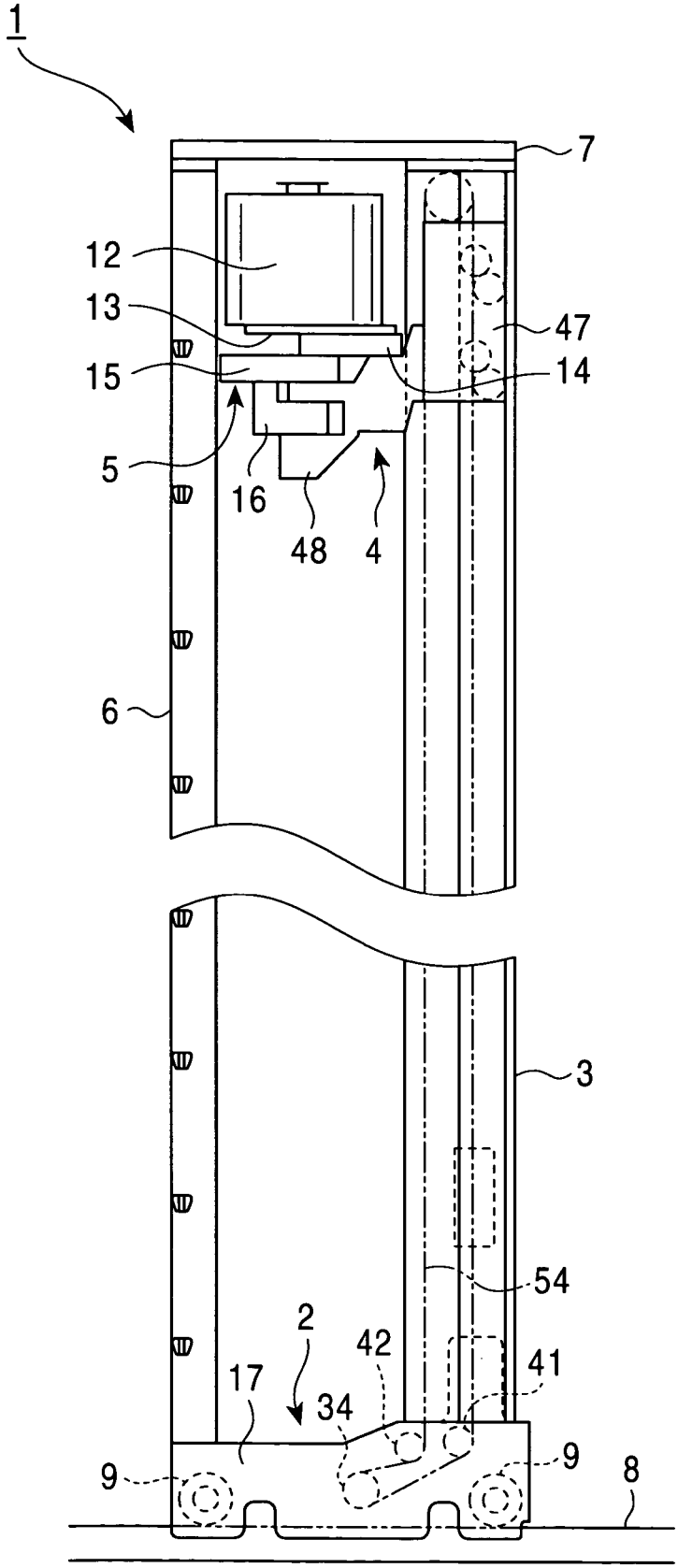
FIG. 1 is a side view of a stacker crane.

As shown in FIG. 1, the stacker crane 1 comprises a traveling vehicle 2 running on a floor, a mast 3 extending vertically from the traveling vehicle 2, and a platform 4 elevating and lowering along the mast 3. The platform 4 is provided with a transfer device 5 that transfers an article 12.

The mast 3 is provided on the traveling vehicle 2 in either its front or rear in its running direction. A ladder 6 is provided opposite the mast 3, i.e. in the rear or front of the traveling vehicle 2 in the same direction. The mast 3 and the ladder 6 are each fixed at its lower end to the traveling vehicle 2 and fixed at its upper end to a pair of bridging frames 7, 7 that bridges the mast 3 to the ladder 6. The ladder 6 and the bridging frames 7, 7 cooperate in reinforcing the mast 3, along which the platform 4 elevates and lowers. This improves the rigidity of the stacker crane 1.

Figure 2:
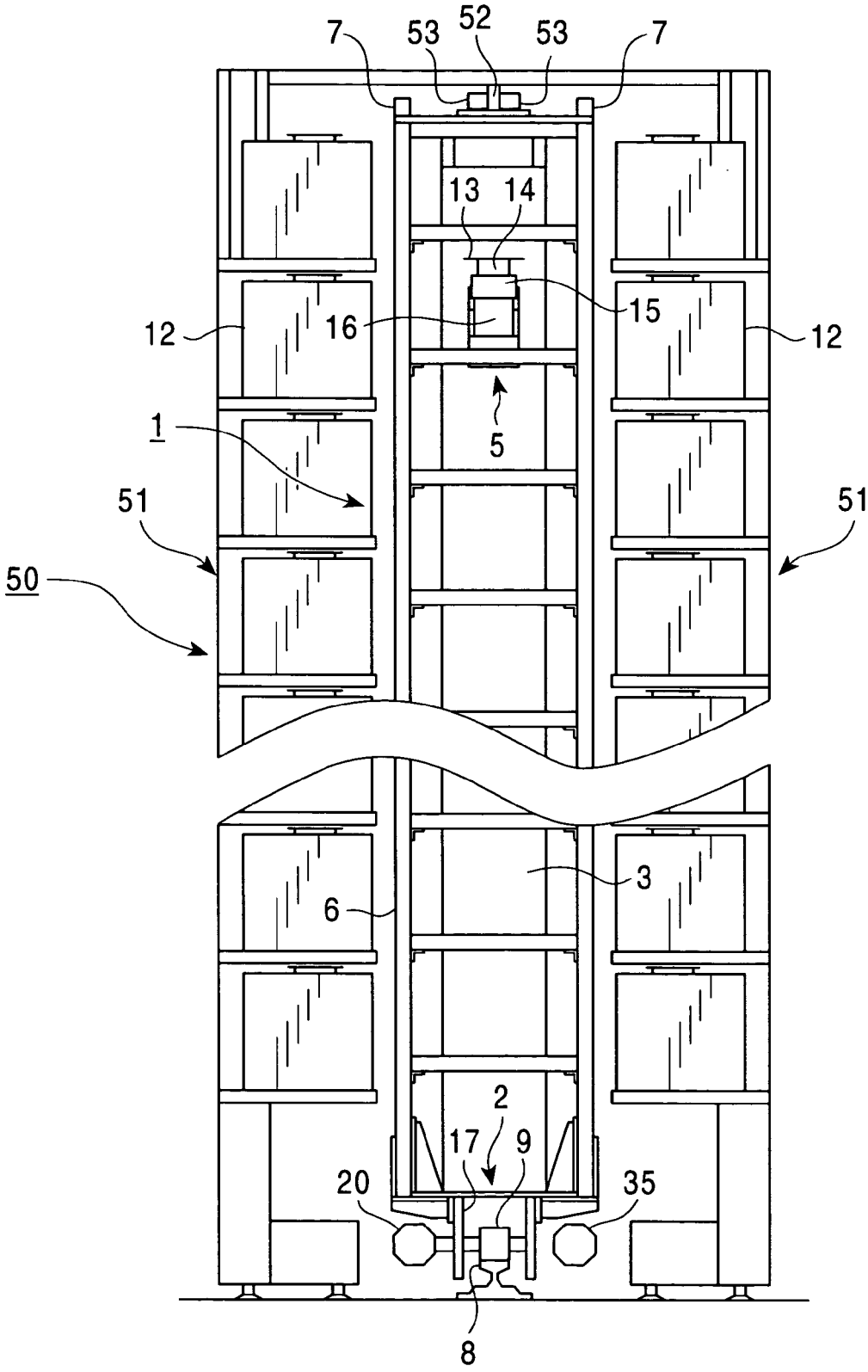
FIG. 2 is a front view of the stacker crane.

As shown in FIG. 2, the stacker crane 1 is a transfer device provided in an automatic warehouse 50. In the automatic warehouse 50, a rail 8 is fixed to the floor as a traveling path for the stacker crane 1. Racks 51 are arranged at the respective sides of the traveling path and comprises a large number of article placing tables arranged in the front-to-rear direction and in the lateral direction.

Figure 5:
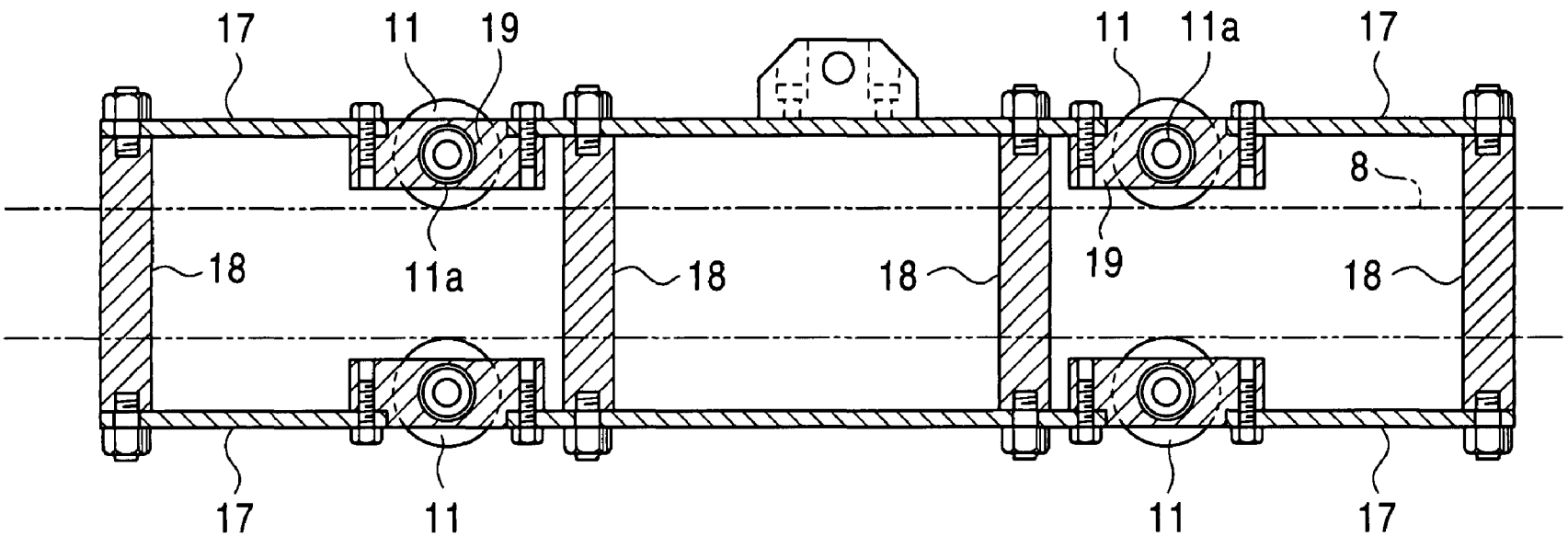
FIG. 5 is a sectional view taken along line V—V in FIG. 4.

The traveling vehicle 2 is provided with wheels 9, 9 arranged in its front and rear, respectively, at a predetermined distance from each other and traveling on the top surface of the rail 8. Thus, the wheels 9, 9 are rotatively driven to cause the stacker crane 1 to run along the rail 8. Further, the traveling vehicle 2 is also provided with two pairs of guide rollers 11, 11 arranged in its front and rear, respectively, and using the respective sides of the rail 8 as guide surfaces (FIG. 5). The guide rollers 11, 11, . . . are abutted against the respective sides of the rail 8 so as not to cause the wheels 9, 9 to slip off from the rail 8. Further, a guide rail 52 is suspended downward from a ceiling side of the automatic warehouse 50 so as to extend parallel with the rail 8. Furthermore, a pair of guide rollers 53, 53 abutting against the respective sides of the guide rail are provided at the upper end of the mast 3 and ladder 6 so as to be rotatively movable. The stacker crane 1 is supported at both its top and bottom, i.e. at both its floor surface side and ceiling side.

The transfer device 5 is composed of a scalar arm type robot hand comprising a hand 13 that carries out placement of the article 12, a first arm 14, and a second arm 15. The hand 13 and the arms 14, 15 are connected to the same driving source via a speed reducer, a belt, and the like. The hand 13 and the arms 14, 15 can be moved forward and backward relative to the platform 4 with the direction of the hand 13 fixed. The platform 4 is provided with a pivoting arm 16 that can be rotatively moved in the lateral direction, as a turning means for the transfer device 5. The transfer device 5 is supported by the pivoting arm 16. The transfer device 5 can be rotatively moved in the lateral direction to transfer the article 12 to one of the racks 51, arranged at the respective sides of the traveling path for the stacker crane 1.

Further, the platform 4 comprises a guide member 47 guided by the mast 3 and a support 48 projecting from the guide member 47 toward the ladder 6. A driving source that drives the pivoting arm 16, and the like are housed in the support 48 and is shaped to project below the guide member 47.

Figure 6:
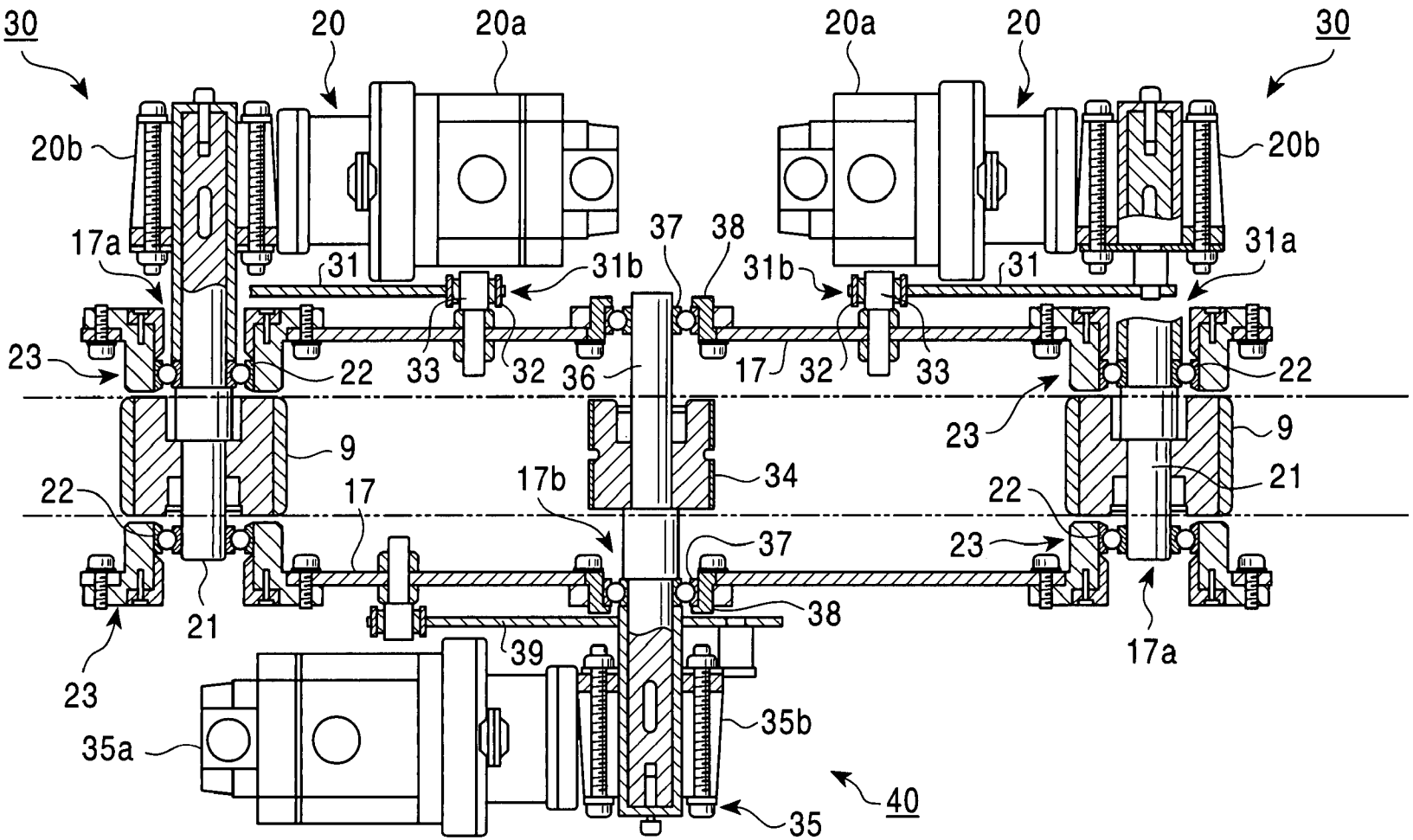
FIG. 6 is a sectional view taken along line VI—VI in FIG. 4.

Now, a configuration of the traveling vehicle 2 will be described. As shown in FIGS. 5 and 6, a pair of frames 17, 17 formed of plate materials is arranged so that the frames 17, 17 are arranged parallel with each other at a predetermined distance. The frames 17, 17 are connected together by cylindrical connection members 18, 18, . . . each formed with thread grooves at its respective ends. Each connection member 18 is fixed to the frame 17 using bolts.

As shown in FIG. 5, the two pairs of guide rollers 11, 11 arranged at the bottom of the traveling vehicle 2 in its front and rear, respectively. Each guide roller 11 is supported on an axle 11*a* extending in a vertical direction. The axle 11*a* is fixed to a support 19 extending vertically from the inner surface of the corresponding frame 17. Further, as shown in FIGS. 3 and 4, parts of each of the right and left frames 17, 17 which correspond to the guide rollers 11 and the axles 11*a* are punched out so that the guide rollers 11 can be easily replaced or maintained.

Figure 3:
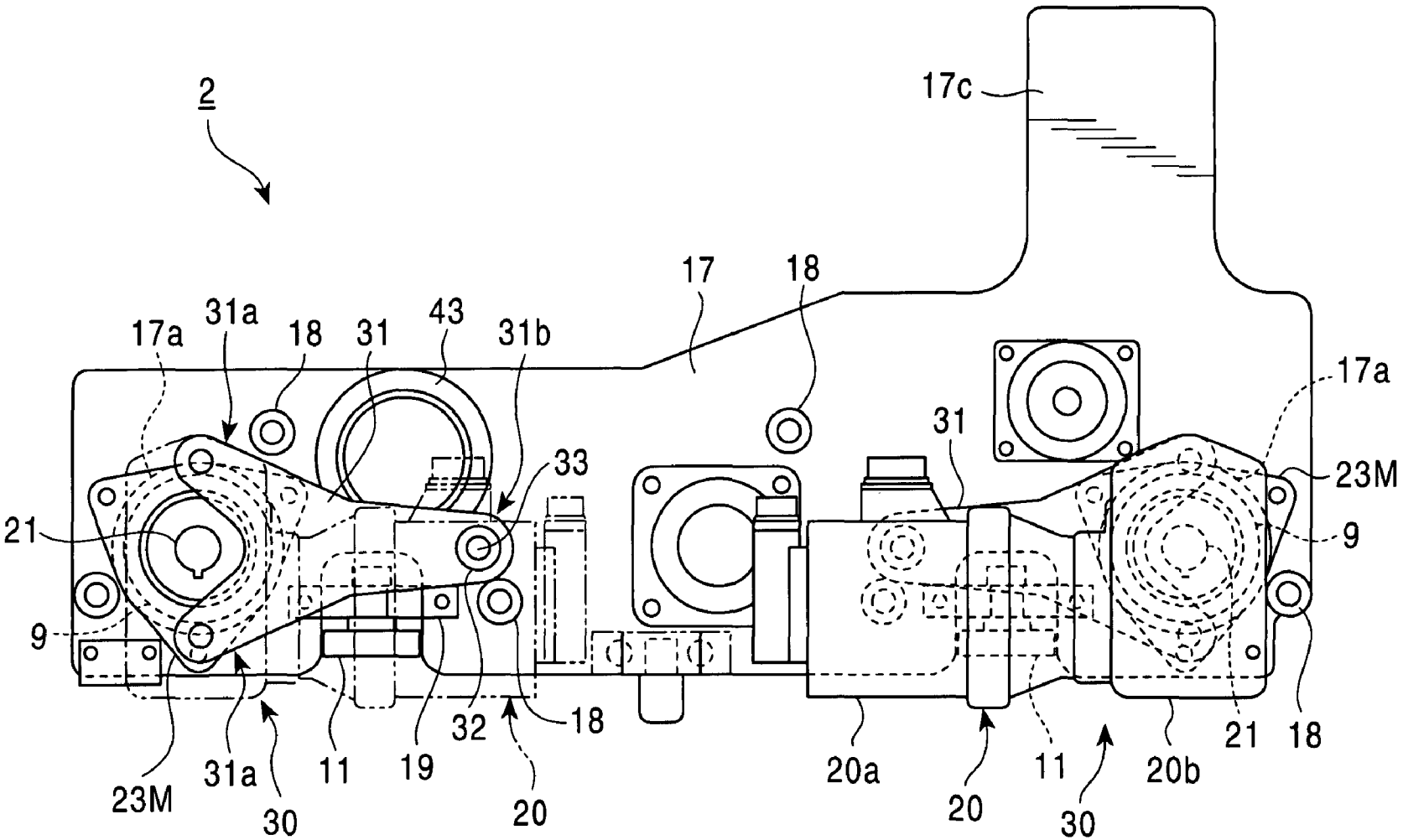
FIG. 3 is a left side view of a traveling vehicle.
Figure 4:
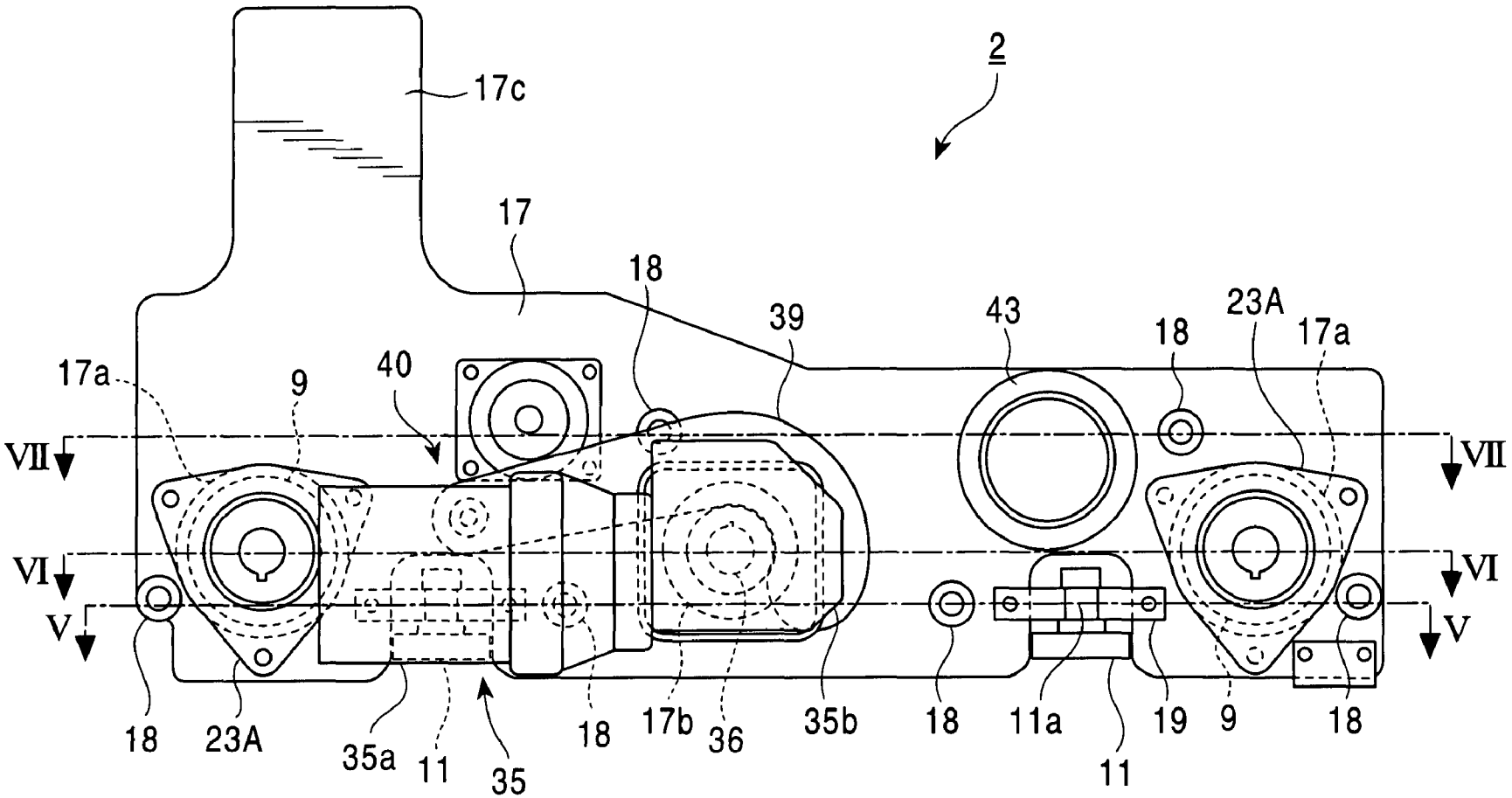
FIG. 4 is a right side view of the traveling vehicle.

As shown in FIGS. 3 and 6, traveling driving units 30, 30 are arranged on either the right or left of the traveling vehicle 2 to drive the wheels 9, 9, respectively. Further, as shown in FIGS. 4 and 6, an elevation driving unit 40 is disposed opposite the traveling driving units 30, 30, i.e. on either the left or right of the traveling vehicle 2 to elevate and lower the platform 4 drivingly.

The traveling driving units 30, 30 are arranged in the front and rear, respectively, of the traveling vehicle 2. As described later in detail, each traveling driving unit 30 comprises traveling driving means 20 for driving the corresponding wheel 9. The traveling driving means 20 is composed of a driving motor 20*a* and hypoid gear type speed reducer 20*b* connected together. The front and rear traveling driving means 20, 20 are controlled so as to be driven synchronously.

As shown in FIG. 6, each wheel 9 is arranged in the lateral center of the traveling vehicle 2 between the frame 17 and the frame 17. An axle 21 to which the wheel 9 is fixed constitutes an output shaft of the traveling driving means 20. The axle 21 is supported by bearings 22, 22 at the right and left, respectively, of the wheel 9 so as to be rotatively movable. The bearings 22, 22 are supported by bearing supporting members 23, 23, respectively, attached to the corresponding frame 17.

Attaching holes 17*a*, 17*a* are formed in the front and rear, respectively, of each frame 17 to allow the axles 21 to be inserted through these holes and to allow the bearing supporting members 23, 23 to be attached. Each attaching hole 17*a* is formed to have a larger diameter (outer diameter) than the wheel 9. Thus, each wheel 9 can be removed by passing it through the corresponding attaching hole 17*a*. The bearing supporting members 23, 23 are attached to the respective attaching holes 17*a*, 17*a*. Then, the bearings 22, 22 are attached to the respective bearing supporting members 23, 23 to support the corresponding axle 21.

Further, the traveling driving unit 30 is provided with a torque arm 31 used to attach its traveling driving means 20 to the corresponding frame 17. As shown in FIG. 3, the torque arm 31 is generally Y' shaped in a side view and is arranged on the traveling vehicle 2 in a position such that the letter Y is laid sideways. Both branching-(forking-)side ends 31*a*, 31*a* of the torque arm 31 are fixed to the corresponding speed reducer 20*b* with bolts so as to sandwich the corresponding axle 21 between them in the vertical direction. A boss 32 is fitted into a non-branching-side end 31*b* of the torque arm 31. The boss 32 is loosely fitted into a cylindrical member 33 provided on the outer surface of the corresponding frame 17 so as to project outward from and perpendicularly to the frame 17. Since the traveling driving means 20 is attached to the corresponding frame 17 via the corresponding torque arm 31, this attachment can be carried out without paying much attention to manufacturing errors in the bearing supporting member 23, attaching hole 17*a*, and others. Further, the traveling driving means 20 can be freely removed from and then installed back on the corresponding frame 17 together with the corresponding torque arm 31. The torque arm 31 locks the corresponding traveling driving unit 30, which can be rotatively moved around the corresponding axle 21, on the traveling vehicle 2 main body so as to prevent the traveling driving unit 30 from being rotated.

Thus, the traveling driving unit 30 is composed of the traveling driving means 20, the wheel 9, the axle 21, the bearing 22, the bearing supporting member 23, and the torque arm 31. The traveling driving unit 30 can be integrally attached to and removed from the frame 17 from its side by passing the corresponding wheel 9 through the corresponding attaching hole 17*a*.

As shown in FIGS. 4 and 6, the elevation driving unit 40 comprises an elevating pulley 34 around which a belt 54 is wound to drive the platform 4 and elevation driving means 35 for driving the elevating pulley 34. The elevation driving means 35 is composed of a driving motor 35*a* and a hypoid gear type speed reducer 35 connected together. Further, the elevating pulley 34 is fixed to an output shaft 36 of the elevation driving means 35. The output shaft 36 is supported by bearings 37, 37 in turn supported by bearing supporting members 38, 38, respectively, attached to the output shafts 17*b*, 17*b*, respectively.

Further, the elevation driving unit 40 is provided with a torque arm 39 used to attach the elevation driving means 35 to the frame 17. The arrangement in which the frame 17 and the elevation driving means 35 are connected together via the torque arm 39 is similar to the arrangement involving the torque arm 31. One end of the torque arm 39 is fixed to the elevation driving unit 40. The other end is removably provided on the frame 17.

Figure 7:
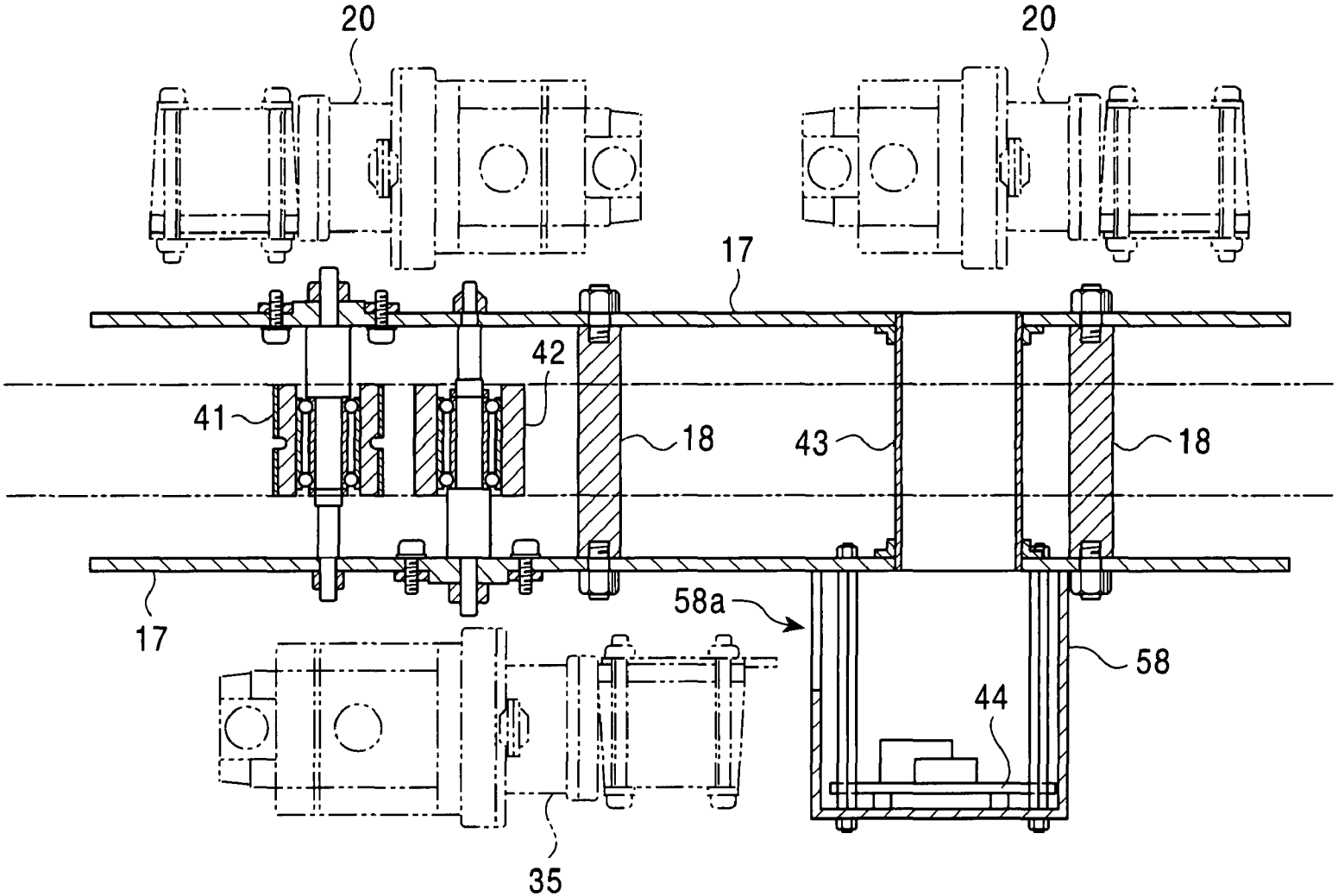
FIG. 7 is a sectional view taken along line VII—VII in FIG. 4.

As shown in FIG. 7, a control substrate 44 is disposed outside one of the frames 17 to control the driving of the traveling driving means 20, 20 and the elevation driving means 35. The traveling driving means 20, 20 are arranged outside one of the frames 17, 17. The elevation driving means 35 and the control substrate 44 are arranged outside the other frame 17. The previously mentioned cylindrical member 43 connects the frames 17, 17 together so that the frames 17, 17 are in communication with each other. Feeder lines and signal lines are passed through the cylindrical member 43 to allow a power supply and transmission of control signals from the outside of the frames 17, 17. The control substrate 44 utilizes the signal lines passing through the cylindrical member 43 to control the traveling driving means 20, 20, located opposite the control substrate 44 across the traveling vehicle 2.

Figure 9:
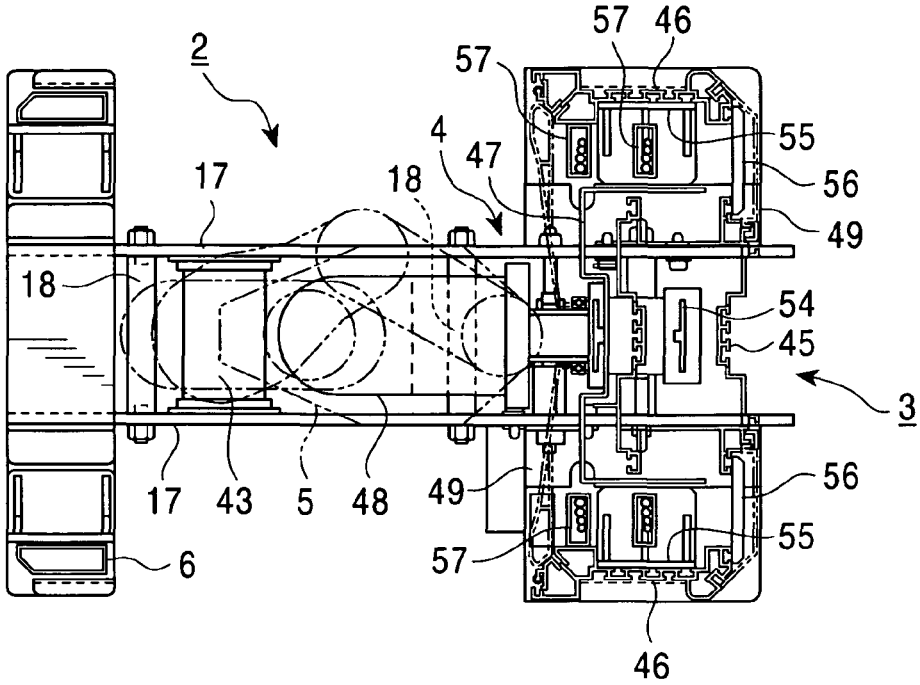
FIG. 9 is a plan view showing a framework arrangement of the stacker crane.

Now, a description will be given of a support arrangement of the mast 3, extending vertically from the traveling vehicle 2. As shown in FIG. 9, the mast 3 is composed of a central main mast 45 and a pair of submasts 46, 46 arranged at the right and left, respectively, of the main mast 45. The main mast 45 is formed to be rectangular in a plan view. Each submast 46 is generally I-shaped in a plan view. A guide member 47 of the platform 4 is slidably supported on the main mast 45 via a guide roller.

Figure 10:
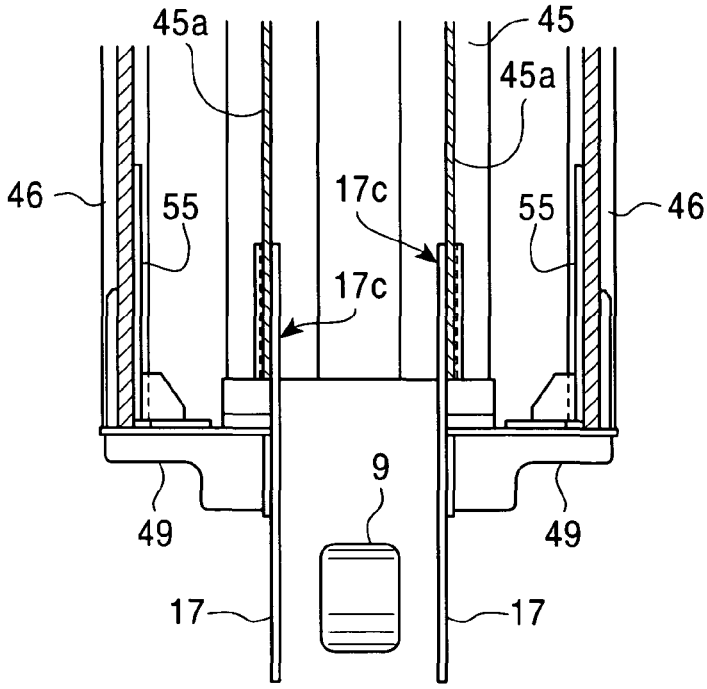
FIG. 10 is a rear view showing a framework arrangement of the bottom of the stacker crane, and specifically showing a support arrangement of a mast.
Figure 11:
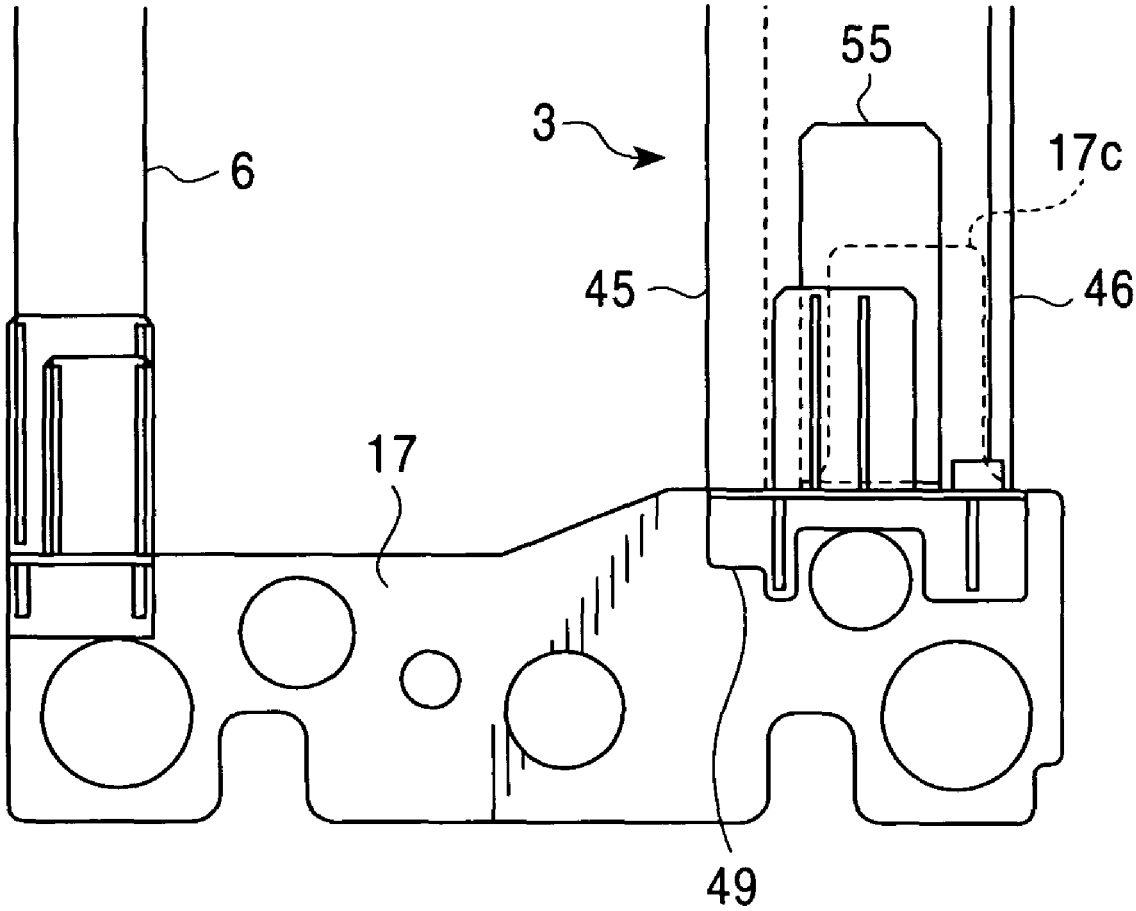
FIG. 11 is a side view showing the framework arrangement of the bottom of the stacker crane, and specifically showing the support arrangement of the mast.

As shown in FIGS. 10 and 11, a right and left inner walls 45*a*, 45*a* of the main mast 45 are arranged outside respective projecting portions 17*c*, 17*c* of the pair of frames 17, 17. Each of the inner wall 45*a* and the corresponding projecting portion 17*c* are fixed together by tightening bolts, to support the main mast 45 on the traveling vehicle 2.

Further, as shown in FIG. 10, mast supporting members 49, 49 extending outward are fixed to the pair of frames 17, 17, respectively, by tightening bolts. A strut 55 extends vertically from each mast supporting member 49, with the submast 46 arranged outside the strut 55. Each submast 46 and the corresponding strut 55 are fixed to each other by tightening bolts. The submast 46 is supported by the corresponding mast supporting member 49.

As shown in FIG. 9, the main mast 45 and each of the right and left submasts 46, 46 are connected together by connection members 56, 56, . . . The connection members 56 are provided along the longitudinal direction of the mast 3 at predetermined intervals to connect supportably the main mast 45 and each submast 46 together. Further, the main mast 45 and each submast 46 are separated from each other to create a space between them in which electric equipment or the like is arranged. Feeder lines 57 are arranged in this space to connect the traveling vehicle 2 and the platform 4 together. One end of each feeder line 57 is supported by the platform 4 with the other side supported by the main mast 45 so that power can be supplied to the transfer device 5, which is elevated and lowered.

Now, a description will be given of a layout of the traveling vehicle 2, located at the bottom of the stacker crane 1.

As described previously, the pair of frames 17, 17 is disposed so that the frames 17, 17 are spaced at a predetermined distance from each other. Further, the frames 17, 17 are connected together by the connection members 18, 18, . . . Furthermore, as shown in FIG. 7, on the top surface of the traveling vehicle 2, driven pulleys 41, 42, the connection member 18, the cylindrical member 43, and the connection member 18 are disposed in this order between the frame 17 and the frame 17 from the mast 3 side toward the ladder 6 side. In this case, on this top surface, a space is delimited by the frames 17, 17 in the lateral direction and by the connection member 18 and cylindrical member 43 in the front-to-rear direction.

Figure 8:
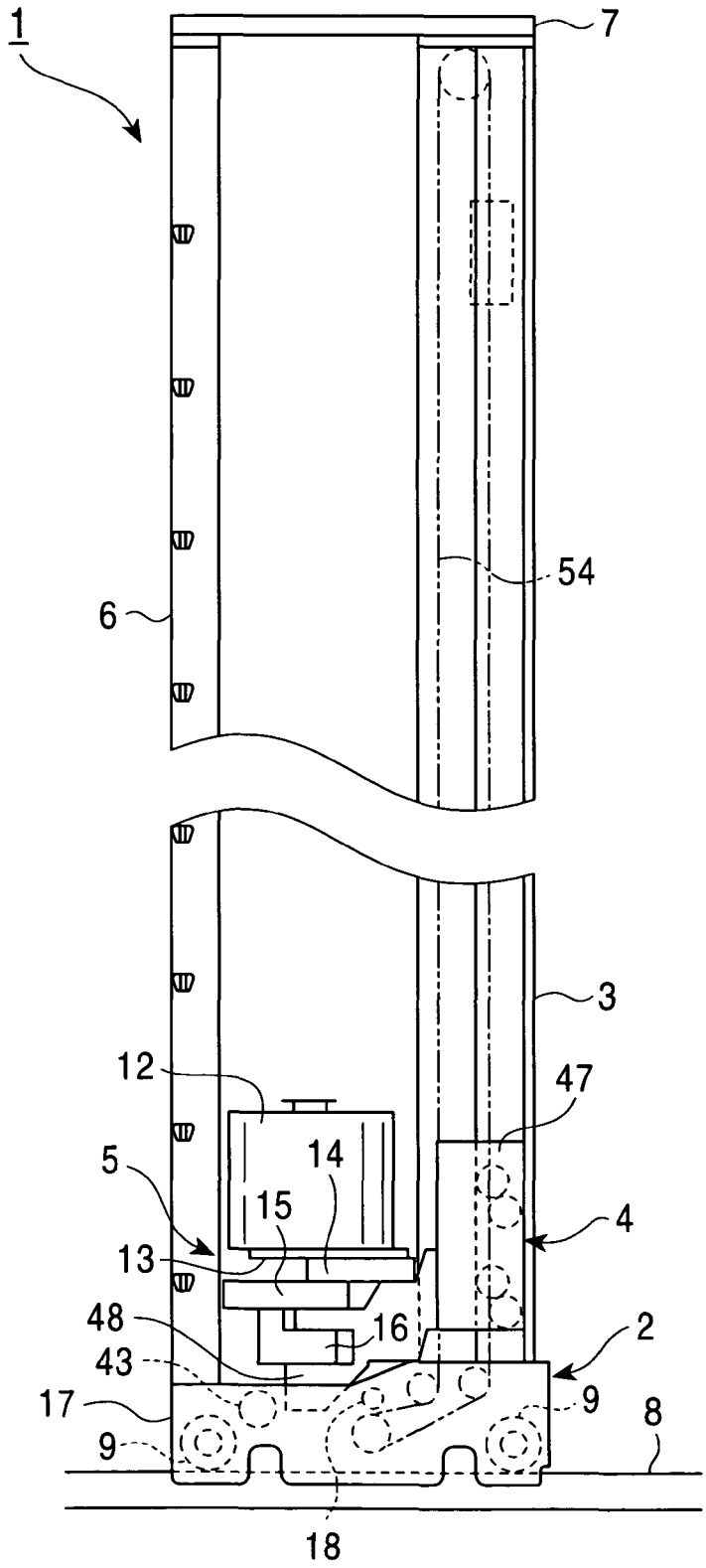
FIG. 8 is a side view of the stacker crane, in which a platform is at its lowermost position.

Further, as shown in FIG. 9, the lateral width of the support 48 is smaller than the separation between the frames 17, 17. Moreover, a space is formed between the pair of frames 17, 17 so that the lower ends of the support 48 and the platform 4 can advance into this space. Thus, as shown in FIG. 8, when the platform 4 is at its lowermost position, a part of the bottom of the platform 4 is housed in the space formed between the frame 17 and the frame 17.

In a side view, the frame 17 overlaps a part of the bottom of the platform 4. Since the mast supporting members 49 are disposed outside the respective frames 17, the platform 4 can be lowered without interfering with mast supporting members 49. This reduces a dead space formed below the platform so as to extend in an elevating and lowering direction.

As shown in FIG. 6, the wheels 9, 9 are arranged at the front and rear ends, respectively, of the pair of frames 17, 17. The wheels 9, 9 are each connected to the corresponding traveling driving means 20 via the corresponding axle 21. The elevating pulley 34, connected to the elevation driving means 35 via the output shaft 36, is arranged between the front and rear wheels 9, 9. Thus, the wheels 9, 9 and the elevating pulley 34 are substantially linearly located. This allows the space between the front wheel 9 and the rear wheel 9 to be utilized as a space in which the elevating pulley 34 is disposed. Consequently, the space between the frame 17 and the frame 17 is effectively utilized. Further, the traveling driving means 20 for driving the wheels 9 and the elevation driving means 35 for driving the elevating pulley 34 can be disposed on the frames 17.

As shown in FIG. 2, the traveling driving means 20, 20 and the elevation driving means 35 are disposed below the lower end of the mast 3. Further, as shown in FIG. 6, the traveling driving means 20, 20 are disposed outside one of the frames 17 of the traveling vehicle 2. The elevation driving means 35 is disposed outside the other frame 17. By thus disposing both driving means 20, 35 at the respective lateral sides of the frames 17 so that the frames 17 overlap both driving means 20, 35 in a side view, the traveling vehicle 2 can be compactly constructed by effectively utilizing the space formed below the mast 3 and without creating any dead space.

As set forth in Claim 1, the present invention provides a carrying apparatus comprising a traveling vehicle, a mast extending vertically from the traveling vehicle, and a platform that elevates and lowers along the mast, wherein the traveling vehicle comprises traveling driving means for wheels, and elevation driving means for elevating and lowering the platform, and both driving means are arranged so that a longitudinal direction of both driving means is almost parallel with a direction in which the traveling vehicle runs. Accordingly, the width of the traveling vehicle can be reduced compared to the case in which the longitudinal direction of the traveling driving means and elevation driving means is set to be orthogonal to a traveling direction.

As set forth in Claim 2, the traveling driving means and the elevation driving means are arranged below the mast and so as not project from a front or rear end of the traveling vehicle in a side view. This prevents an increase in the height of the traveling vehicle. It is also possible to eliminate a dead space extending in the front-to-rear direction of the traveling vehicle and which may be formed owing to both driving means. Consequently, the conveying facility can be moved closer to a wall of the automatic warehouse. This makes it possible to make the traveling vehicle compact and to reduce the floor space of the automatic warehouse.

As set forth in Claims 3 and 4, the traveling vehicle comprises a pair of frames spaced at a predetermined distance from each other and a plurality of connecting members that connect both frames together, and wheels are arranged between the pair of frames in the front and rear, respectively, of the traveling vehicle. Further, traveling driving means is connected to each wheel, and an elevating pulley for the platform is arranged between the front and rear wheels. Furthermore, the elevation driving means is connected to the elevating pulley, and the traveling driving means and elevation driving means are arranged outside the respective frames. Accordingly, the space in the pair of frames can be effectively utilized. The traveling vehicle is stabilized, and the space between the front and rear wheels can be utilized as a space in which the elevating pulley is arranged. This makes the traveling vehicle more compact. Further, when the width of the bottom of the platform is smaller than the spacing between the pair of frames, the bottom of the platform can be housed in the pair of frames.

As set forth in Claim 5, the bottom of the platform can be housed between the pair of frames. Accordingly, the platform can be lowered further to reduce a dead space that may be formed below the platform so as to extend in an elevating and lowering direction.

As set forth in Claim 6, mast supporting members project outward from the respective frames constituting the pair, and the mast is arranged above the frames and mast supporting members. Accordingly, a space can be formed below the mast. By arranging the traveling driving means and the elevation driving means in this space, the space can be effectively utilized. Further, the width of the traveling vehicle can be reduced.

As set forth in Claim 7, the traveling driving means and the elevation driving means are arranged inside an outer surface of the mast in a plan view. This makes it possible to reduce the width of the carrying apparatus. Thus, a widthwise space in the automatic warehouse can be reduced.

The invention claimed is:

1. A carrying apparatus comprising:

a traveling vehicle, a mast extending vertically from the traveling vehicle, and a platform that elevates and lowers along the mast, wherein the traveling vehicle comprises traveling driving means for driving wheels, and elevation driving means for elevating and lowering the platform, wherein both driving means are arranged so that a longitudinal direction of both driving means is parallel with a direction in which the traveling vehicle runs, and wherein the traveling driving means and the elevation driving means are arranged below a bottom of the mast.

2. A carrying apparatus according to claim 1, wherein the traveling driving means and the elevation driving means are arranged so as not to project from a front or rear end of the traveling vehicle in a side view.

3. A carrying apparatus according to claim 1, wherein the traveling vehicle further comprises a pair of frames spaced at a predetermined distance from each other and a connecting member that connects both frames together, and wherein wheels are arranged between the pair of frames in the front and rear, respectively, of the traveling vehicle, traveling driving means being connected to each wheel, an elevating pulley for the platform being arranged between the front and rear wheels, the elevation driving means being connected to the elevating pulley, the traveling driving means and elevation driving means being arranged outside the respective frames.

4. A carrying apparatus according to claim 2, wherein the traveling vehicle further comprises a pair of frames spaced at a predetermined distance from each other and a connecting member that connects both frames together, and wherein wheels are arranged between the pair of frames in the front and rear, respectively, of the traveling vehicle, traveling driving means being connected to each wheel, an elevating pulley for the platform being arranged between the front and rear wheels, the elevation driving means being connected to the elevating pulley, the traveling driving means and elevation driving means being arranged outside the respective frames.

5. A carrying apparatus according to claim 3, wherein a bottom of the platform can be housed between the pair of frames.

6. A carrying apparatus according to claim 3, wherein mast supporting members project outward from each respective frame constituting the pair of frames, and the mast is arranged above the frames and mast supporting members.

7. A carrying apparatus according to claim 6, wherein the traveling driving means and the elevation driving means are arranged inside an outer surface of the mast in a plan view.

* * * * *